US007254905B2

(12) United States Patent
Dennison

(10) Patent No.: US 7,254,905 B2
(45) Date of Patent: Aug. 14, 2007

(54) RELEASABLE ATHLETIC SHOE SOLE

(76) Inventor: James M. Dennison, 2938 Lumbard Rd., Clinton, NY (US) 13323

( * ) Notice: Subject to any disclaimer, the term of this patent is extended or adjusted under 35 U.S.C. 154(b) by 268 days.

(21) Appl. No.: 10/821,495

(22) Filed: Apr. 9, 2004

(65) Prior Publication Data

US 2004/0221486 A1 Nov. 11, 2004

Related U.S. Application Data

(60) Provisional application No. 60/461,537, filed on Apr. 9, 2003.

(51) Int. Cl.
*A63C 13/00* (2006.01)

(52) U.S. Cl. ..... 36/15; 36/59 R

(58) Field of Classification Search ..... 36/100, 36/101, 15, 117.3, 30 R, 31, 36 R, 36 A, 36/36 B, 36 C, 42, 19.5, 24
See application file for complete search history.

(56) References Cited

U.S. PATENT DOCUMENTS

| | | | | |
|---|---|---|---|---|
| 1,696,058 A | | 12/1928 | Rubin | |
| 1,831,268 A | * | 11/1931 | Starks | 36/36 R |
| 2,252,404 A | * | 8/1941 | Mauser | 36/36 R |
| 2,431,868 A | * | 12/1947 | Gilmour | 36/42 |
| 2,582,551 A | * | 1/1952 | Malherbe | 36/42 |
| 3,668,792 A | | 6/1972 | York | 36/59 R |
| 3,982,336 A | * | 9/1976 | Herro | 36/15 |
| 4,114,296 A | * | 9/1978 | Smith | 36/101 |
| 4,262,434 A | | 4/1981 | Michelotti | 36/67 |
| 4,317,294 A | * | 3/1982 | Goodyear | 36/100 |
| 4,377,042 A | | 3/1983 | Bauer | 36/101 |
| 4,570,363 A | | 2/1986 | Annovi | 36/117 |
| 4,606,139 A | * | 8/1986 | Silver | 36/15 |
| 4,887,369 A | | 12/1989 | Bailey et al. | 36/101 |
| 4,924,608 A | | 5/1990 | Mogonye | 36/62 |
| 5,224,810 A | | 7/1993 | Pitkin | 36/30 R |
| 5,255,453 A | | 10/1993 | Weiss | 36/134 |
| 5,317,822 A | * | 6/1994 | Johnson | 36/101 |
| 5,456,027 A | * | 10/1995 | Tecchio et al. | 36/134 |
| 5,617,653 A | | 4/1997 | Walker et al. | 36/134 |
| 5,644,857 A | * | 7/1997 | Ouellette et al. | 36/15 |
| 5,685,092 A | | 11/1997 | Prieskorn | 36/93 |
| 5,692,322 A | | 12/1997 | Lombardino | 36/100 |
| 5,743,029 A | | 4/1998 | Walker et al. | 36/134 |
| 5,761,833 A | | 6/1998 | McMullin | 36/67 D |
| 5,867,923 A | | 2/1999 | Lehneis | 36/25 R |
| 6,035,559 A | | 3/2000 | Freed et al. | 36/134 |
| 6,311,416 B1 | | 11/2001 | Cohen | 36/136 |
| 6,813,847 B2 | * | 11/2004 | Workman | 36/15 |
| 2001/0042319 A1 | * | 11/2001 | Coomes | 36/100 |
| 2002/0184792 A1 | | 12/2002 | Sugawara | |

FOREIGN PATENT DOCUMENTS

| | | |
|---|---|---|
| WO | WO94/16588 | 8/1994 |

* cited by examiner

*Primary Examiner*—Ted Kavanaugh
(74) *Attorney, Agent, or Firm*—Joseph P. Quinn

(57) ABSTRACT

A unique athletic shoe sole that is constructed of two more separate pieces designed to release when a predetermined longitudinally directed force is applied. A releasable athletic shoe sole includes a detachable lower sole; a mechanical release mechanism constructed to release when a predetermined force is applied; and a longitudinal guiding element. The longitudinal guiding element allows the lower sole to detach specifically in a longitudinal direction. The longitudinal direction of release prevents knee ligament injuries, particularly ACL injuries.

25 Claims, 10 Drawing Sheets

| | QUADRACEPS | HAMSTRINGS | CENTER OF GRAVITY OF BODY | TRANSLATION FORCE ON TIBIA | FOOT | KNEE |
|---|---|---|---|---|---|---|
| NORMAL STOPPING | NORMAL FIRING/ CONTRACTION | NORMAL FIRING/ CONTRACTION | IN FRONT OF KNEE | EQUAL QUAD/HAM CONTRACTION -NO ANT./POST-FORCE | FIXED ON FLOOR | NO INJURY |
| NONCONTACT ACL INJURY | MAXIMAL FIRING/ CONTRACTION | NORIMAL FIRING/ CONTRACTION | BEHIND KNEE | UNBALANCED QUAD/HAM CONTRACTION; LEADS TO ANTERIOR FORCE | FIXED ON FLOOR | ACL TEARS |
| INJURY PREVENTING SHOE SOLE | MAXIMAL FIRING/ CONTRACTION | NORMAL FIRING/ CONTRACTION | BEHIND KNEE | UNBALANCED QUAD/HAM CONTRACTION NO ANT./POST. FORCE SINCE FOOT NOT FIXED | RELEASES ALLOWING LEG TO EXTEND | NO ACL INJURY |

FIG. 16

RELEASABLE ATHLETIC SHOE SOLE

CROSS REFERENCE TO RELATED APPLICATIONS

The present application claims priority to U.S. Provisional Patent Application Ser. No. 60/461,537 filed Apr. 9, 2003.

FIELD OF THE INVENTION

This disclosure relates generally to an apparatus for an athletic shoe and more particularly to an athletic shoe sole constructed of two or more pieces designed to release when a predetermined longitudinal (i.e., posterior to anterior) directed force is applied.

BACKGROUND OF THE INVENTION

Sports participation in the United States and the world has significantly increased over the past half decade. Recent U.S. Census data reflects these trends in athletics. According to census reports, in 1971 approximately 3.9 million high school students were involved in organized athletics. This compares to the 1998–1999 school year when approximately 6.5 million students participated in sports. These trends are also seen in organized collegiate sports participation, to say nothing of the dramatic increase within the general population of the number of people involved in recreational athletic activities.

In addition to the rise in athletic participation over the past thirty years, there has been a significant change in the demographics regarding who is involved in athletic activities. The implementation of Title IX legislation is largely responsible for this changing demographic. In particular, Title IX has been widely credited with the dramatic rise in female sports participation. With the increase in sports participation has come an increase in sports-related injuries.

Participation in sports, by definition, involves a risk of injury. The goal of sports medicine specialists is to define the injury patterns and mechanisms by which these injuries occur. As a greater fund of knowledge has accumulated regarding sports-related injuries, the aim of researchers and clinicians has shifted toward identifying what risk factors can be controlled in an effort to prevent injury.

Serious knee injuries, such as anterior cruciate ligament (ACL) tears have become commonplace at all levels of participation ranging from high school sports to professional athletes. It has been estimated that 80,000 ACL injuries occur annually in the United States. The vast majority of these injuries are sports related. Injury rates greater than 1 in every 3000 sports participants have been reported. An estimated $1 billion is spent annually to treat these injuries.

With the rapid rise of female athletics, has come very disturbing trends regarding the injury rates between male and female athletes. Studies have reported ACL injuries are 2 to 8 times more common in female athletes when compared to their male counterparts. In addition, approximately 70% of the catastrophic knee ligament injuries occurring in sports are non-contact in nature.

In order to understand the rationale behind preventing ACL injuries, it is first necessary to have a basic knowledge of the anatomy of the knee joint. The knee is typically described as a hinge-type joint. In reality the knee does not behave as a simple hinge. It has six degrees of freedom, including translation and rotational motions. As with all joints, the stability of the knee is determined by the complex interplay between the bony architecture, the static stabilizers and the dynamic stabilizer (i.e., muscles) around the joint.

The anatomy of the knee joint includes three bones—the distal femur (aka, thighbone), the proximal tibia (aka, shinbone) and the patella (aka, kneecap). The static stabilizers of the knee include four strong ligaments. They are responsible for tightly binding the femur and tibia together. These ligaments not only provide the static stability to the joint, but also the direction in which they run determines the plane of motion that the joint can move in. The four major knee ligaments are the following: (1) medial collateral ligament, (2) lateral collateral ligament, (3) posterior cruciate ligament and (4) anterior cruciate ligament.

The ACL attaches to both the femur and tibia. It is the primary restraint preventing anterior tibial translation (i.e., it prevents the tibia from sliding forward on the femur). It is a secondary restraint to internal rotation, varus-valgus angulation and knee hyperextension. In essence it allows athletes to perform decelerating, twisting and pivoting activities. When the ACL is torn athletes are left with a"trick" knee that may give out during such activities.

It is a well-recognized fact that the risk of injury is inherent in any athletic activity. While it was once a widely held belief that most knee ligament injuries in sports were the result of direct contact between players, research has convincingly shown that this is not the case. The majority of ACL injuries occurring in sports are not related to contact between participants. They are in fact non-contact injuries.

Much research has been directed at identifying as precisely as possible the risk factors for ACL injury in order to determine which risk factors are preventable. Risk factors associated with catastrophic knee injuries can be categorized into four main areas. These categories include the following: (1) environmental risks, (2) anatomic risks, (3) hormonal risks and (4) biomechanical risks. While there may be opportunity for risk reduction in all of these areas, simple changes in environmental factors may have profound influence over the risk of ACL injuries. Environmental risk factors associated with knee injury encompass such areas as equipment, braces, and the interaction between the playing surface and the athletic shoe.

Since the mid-1970's it has been known that there is a direct correlation between knee injuries and friction between the athlete and the athletic surface. A study examining the incidence of knee injuries in football players showed that as the friction between the playing shoe and the playing surface increased there was an increase in knee injuries. This finding was not unique to football injuries, it has been shown with injuries in tennis as well. A study in 2002 of ACL injuries in military recruits during obstacle coarse training also proved the role of increased friction at the sole-surface interface as being directly related to the risk of ACL injuries.

At its most basic level, the ultimate mechanism that causes a ligament injury is that the load applied to the ligament is larger than the ligament's capacity to sustain it. Review of videotape of athletes suffering actual non-contact ACL tears reveals that most frequently these injuries occur when the athlete is decelerating, changing direction or landing from a jump. Analysis further shows that the player usually has landed "awkwardly" with their foot flat and the center of gravity of the body behind the center of the knee.

Laboratory data combined with videotape of athletes suffering tears of their ACLs explain why these injuries occur during cutting, decelerating and landing activities. It has been shown that when landing from a jump the angle of the athletes knee at impact is on average 22 degrees. Studies have documented that the anterior shear force across the knee created by a quadriceps contraction is the greatest when the knee is flexed between 0–30 degrees. Furthermore, the muscle firing data confirms that as an athlete lands from a jump the quadriceps muscle is maximally firing which places a maximal anterior shear force across the knee. Add to this the fact that at the same time the quadriceps is drawing the tibia forward the hamstrings are only minimally active to counter activate this strong forward pull. This combination of marked quadriceps activity and minimal hamstring activity places the ACL under significant tension and increases the risk of ligament rupture.

It has also been documented in gait lab analysis that the body's corrective action in an attempt to regain balance and control when landing "awkwardly" is to maximally contract the quadriceps muscle. The reason that a strong quadriceps contraction can provide an anterior shear force on the ACL of sufficient magnitude to rupture the ligament is that the foot is fixed to the playing surface. If the foot is not fixed to the playing surface, then when the quadriceps contracts the muscle simply extends the knee and no anterior shear force is created in the knee. Therefore, by controlling the shoe-surface interface, we can eliminate the anterior shear and in doing so we can help prevent non-contact ACL injuries.

Various break-away shoes have been designed in efforts to reduce the incidence of injuries in athletes. For example, U.S. Pat. No. 3,668,792 to York describes an athletic safety shoe having an upper sole mounted on the body of a shoe and a lower breakaway safety sole having traction means on the underside thereof which is releasably attached to the upper sole by a breakaway safety mechanism. The safety sole has a generally transversely extending grooved track configured to slideably receive a generally transverse rib. The breakaway sole is designed to prevent longitudinal (anterior-posterior) movement between the upper and lower soles and to allow transverse (medial-lateral) movement between the upper and lower soles when a threshold transverse shearing force is applied therebetween.

U.S. Pat. No. 5,617,653 to Walker et al. (hereinafter "Walker et al.") describes a cleat assembly for athletic shoes which includes a base assembly and a cleat which is releasably coupled to the base assembly. The cleat is designed to release from the base assembly in response to a predetermined force extending substantially lateral to the longitudinal axis of the shoe. The cleat described in Walker et al. allows for a release in a transverse (medial-lateral) direction.

U.S. Pat. No. 5,867,923 to Lehneis discloses an orthotic shoe 10, having an insole 14 and an outsole 16 that are mounted to a pivot 18 to allow relative rotation therebetween about an axis perpendicular to the sole.

U.S. Pat. No. 5,224,810 to Pitkin discloses an athletic shoe designed to provide a safe orientation of the foot during an immediate stop in the medial lateral direction. The shoe sole has an upper sole member 3 and a lower sole member 4 which are elastically connected by a resilient member 5 along the lateral and medial edges of the shoe. The elastically connected sole members allow motion therebetween during rapid stopping in the medial direction.

U.S. Pat. No. 3,982,336 to Herrog discloses an athletic shoe with a breakaway sole. The shoe has grooves 26, 28 and 30 and projections 32, 34 and 36 to allow the lower sole 16 to be released from the upper sole 14 when a lateral force is applied across the shoe 12 which would be incurred when an injurious or harmful force is applied to the leg of an athlete.

These and other previously known safety shoe designs were neither designed nor intended to release in a longitudinal direction. As such, there is a need for a shoe sole design that helps to prevent ACL injuries by ensuring that the anterior shear force at the knee does not exceed the tensile strength of the ligament.

SUMMARY OF THE INVENTION

The present invention provides a method and apparatus for helping to prevent ACL injuries by ensuring that anterior shear forces at the human knee does not exceed the tensile strength of the ACL.

The present invention provides a shoe sole that releases in a longitudinal (posterior-anterior) direction prior to the force necessary to tear the native ACL from being generated in the knee. The releasable shoe sole allows the shoe to absorb energy and thereby helps to prevent injury to the ACL.

As described above, in order to reduce the risk of sports related ACL injuries it is necessary to control the interaction between the athletic shoe and the playing surface. The present invention includes a sole constructed of two or more separate pieces designed to "fail" when a predetermined force is applied across them. The invention thereby places a "safety-valve" within the shoe to control the stress across the knee. When a force greater than that required to tear the native ACL is generated at the shoe—playing surface interface, the athletic shoe sole according to illustrative embodiments of the present invention will allow a shoe to absorb energy and thereby prevent the user's ACL from being injured.

The athletic shoe sole described according to the present invention include a two or more piece sole with a releasable lower sole; a longitudinal guiding element; and a mechanical release mechanism that is constructed to release when a predetermined longitudinal force is applied. The design allows the upper half of the sole to slide over the lower half of the outer sole when the force exceeds the force required to tear the player ACL. Simply stated, the shoe's internal "ligament" would rupture instead of the players ACL.

The two pieces of the sole could be secured together in multiple ways. Such possibilities could include an actual "ligament" band running obliquely from the distal (i.e., towards the toes) portion of the upper one half of the sole to the proximal (i.e., toward the heel) portion of the lower one half of the sole. Another design option could include the two pieces of the sole being secured by a "shear pin" designed to fail at a predetermined strain allowing the upper sole to slide forward on the lower sole. A third such option would be to have the two pieces of the sole "spot welded" together during manufacturing, such that the welds would break at a predetermined limit allowing for the pieces of the outer sole to slide past one another.

One illustrative embodiment of the invention provides a shoe sole including a first sole element and a second sole element. The first sole element is associated with said second sole element such that when a threshold force is applied to one of said first sole element and said second sole element, the threshold force causes the first sole element and second sole element to translate longitudinally relative to each other.

In another embodiment, the invention provides an athletic shoe including a body portion, an upper sole element substantially permanently attached to the body portion and a lower sole element releasably attached to the upper sole element such that lateral relative motion between the upper sole element and lower sole element is prevented and longitudinal motion between the upper sole element and lower sole element is resisted up to a predetermined release force.

In yet another embodiment, the invention provides an athletic shoe sole including an upper sole having a bottom surface including a first longitudinal guiding element and a lower sole having a top surface including a second longitudinal guiding element. The second longitudinal guiding element engaging the first longitudinal guiding element and constrains the upper sole to longitudinal motion relative to the lower sole upon exertion of a threshold longitudinal shear force therebetween. The longitudinal guiding elements of the invention can comprise a rail and slot, for example.

The athletic shoe sole according to certain illustrative embodiments of the invention includes a breakaway portion extending through said longitudinal guiding elements and preventing longitudinal translation between the upper sole and lower sole unless a force exceeding a predetermined shear force is exerted therebetween. In one embodiment, for example, the breakaway portion includes one or more shear pins. The shear pins can be separate components, or can alternatively be integrally formed with the upper and/or lower soles.

In another embodiment, the breakaway portion includes a controlled friction portion. For example, the controlled friction portion can be formed as a plurality of teeth in one of the upper or lower soles engaging with a plurality of grooves in the other of the upper and lower soles. Dimensions and shape of the teeth and grooves can be chosen by design to release for example by shearing away upon exertion of a the predetermined shear force between the upper and lower soles. In other embodiments, the breakaway portion can include spot welds or an adhesive layer for example.

Another illustrative embodiment of the present invention provides an athletic shoe sole having a ligament portion connected between the upper sole and said lower sole and preventing longitudinal translation between the upper sole and lower sole unless a force exceeding a predetermined shear force is exerted therebetween. The ligament portion can comprise an elastic band or a spring, for example.

In an alternative embodiment, the invention also includes a plurality of cleats extending downward from said lower sole. In a particular embodiment, at least one cleat can be formed with a shear pin extending upward through said upper and lower sole elements. In some embodiments of the invention, the shear pins are replaceable.

One of the advantages of the athletic shoe sole design according to illustrative embodiments of the present invention is to help prevent ACL injuries by controlling the friction between a player and an athletic surface.

BRIEF DESCRIPTION OF THE DRAWINGS

The above discussed and other features and advantages of the present invention will be appreciated and understood by those skilled in the art from the following detailed description and drawings. Referring to the exemplary drawings wherein like elements are numbered alike in the several Figures:

FIG. 16 is a state table of the knee anatomy under various conditions; and

DETAILED DESCRIPTION

Figure 1:
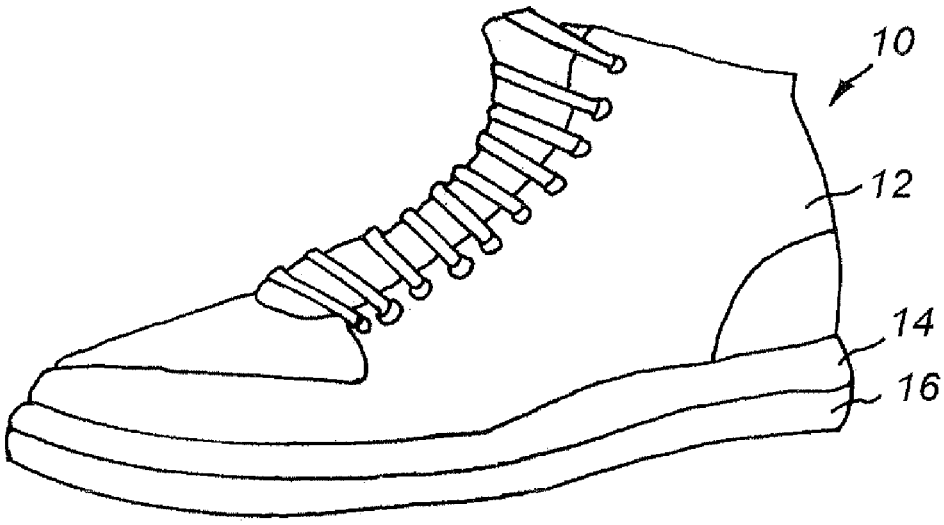
FIG. 1 is a side view of an athletic shoe according to an illustrative embodiment of the invention.

Referring to FIG. 1, a side view of a shoe 10 according to an illustrative embodiment of the invention is shown. The illustrative embodiment shown in FIG. 1 is similar to a typical high-top athletic shoe. The shoe 10 includes an upper portion 12, an upper sole 14 secured to or formed with the upper portion 12. A lower sole 16 is releasably attached to the upper sole 14.

Figure 2:
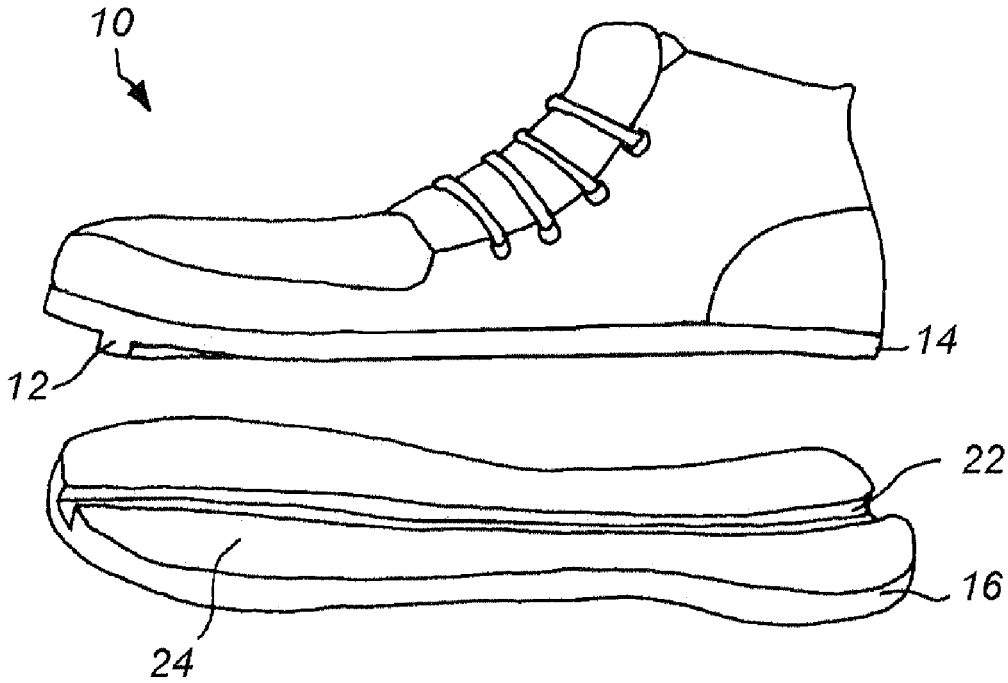
FIG. 2 is an exploded pictorial side view of an athletic shoe having a first sole element and a second sole element shown apart from each other.

Referring to FIG. 2, an exploded view of a shoe 10 according to an illustrative embodiment of the invention is shown. In this view, the lower sole 16 is separated from the upper sole 14 for illustration. A longitudinal guiding portion extends longitudinally along the length of the upper sole 14 and the lower sole 12. In the embodiment shown in FIG. 2, the longitudinal guiding portion includes a longitudinal rail 18 extending downward from the bottom surface 20 of the upper sole 14 and a longitudinal slot 22 extending downward into top surface 24 of the bottom sole 16. It should be understood by persons having ordinary skill in the art that a longitudinal guiding portion could alternatively include a longitudinal rail extending upward from the bottom sole and a slot extending upward into the upper sole without departing from the spirit and scope of the invention.

The illustrative embodiments of the invention include a yieldable attachment portion for releasably securing the top sole to the bottom sole up to a pre-determined longitudinal shear force therebetween. No structure of a yieldable attachment portion is shown in FIG. 2, however it should be understood by persons having ordinary skill in the art that the yieldable attachment portion could include, for example, an adhesive layer and or ultrasonic welds or other attachment means applied between the upper sole 14 and lower sole 16 so long as such attachment means can be designed to a predetermined yield strength in shear.

Figure 3:
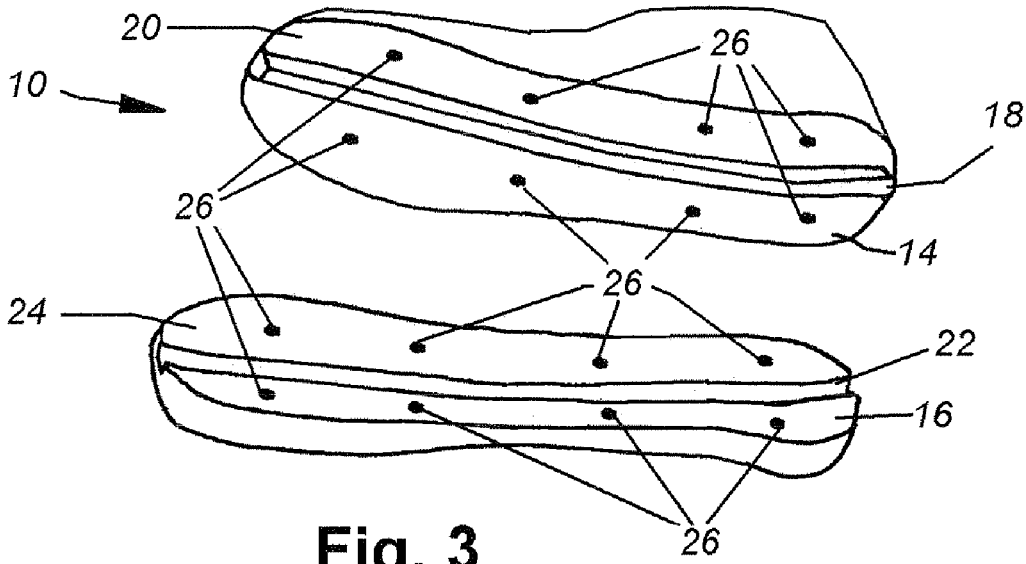
FIG. 3 is an exploded view of the upper and lower soles according to an illustrative embodiment of the invention including a plurality of spot weld locations.

FIG. 3 shows an exploded view of a shoe 10 similar to that shown in FIG. 2 but further including a plurality of releasable attachment portions. The releasable attachment portions shown in FIG. 3 can include spot welds areas and/or adhesive areas, for example.

Figure 4:
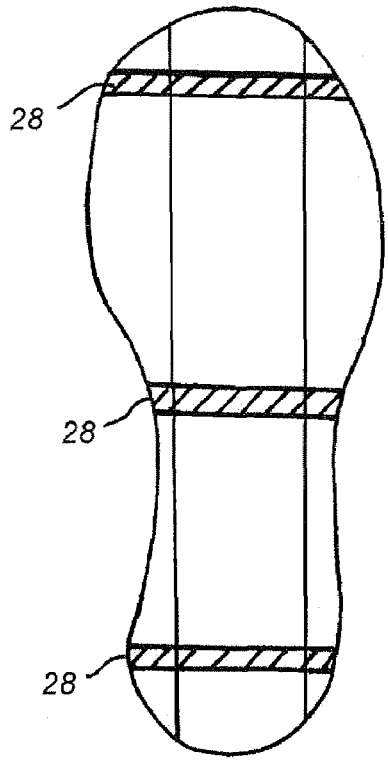
FIG. 4 is a top cross sectional view of combined upper and lower soles having a plurality of shear pins extending therethrough according to an illustrative embodiment of the invention.

In an alternative embodiment of the present invention, the yieldable attachment portion is provided by locating at least one horizontally disposed shear pin through the upper sole 14 and lower sole 16 such that the shear pins intersect the longitudinal guiding portions. FIG. 4 shows the placement of three shear pins through the slot and rail type vertical guiding portion of an upper and lower sole combination.

Referring to FIG. 4, a top down cross sectional view showing a plurality of embodiments of an athletic shoe sole is shown. FIG. 4 shows one embodiment of the internal structure of the sole and depicts how the upper and lower portions of the sole are married together by a longitudinal guiding portion. The shear pins 28 cross lock the upper and lower halves of the sole together. The "shear pins" are designed to "fail" at predetermined load or threshold force level.

Figure 5:
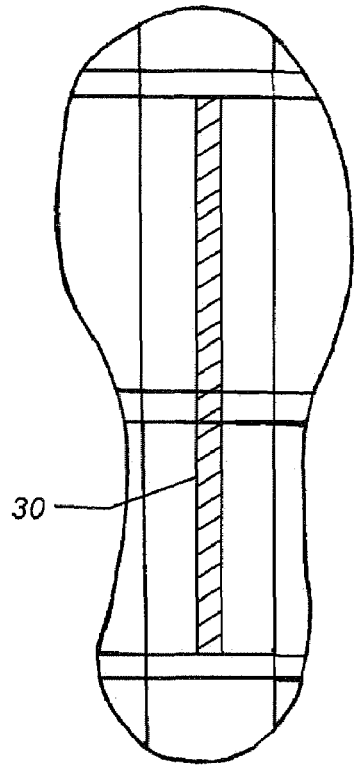
FIG. 5 is a top cross sectional view of combined upper and lower soles having a ligament band extending therebetween according to an illustrative embodiment of the invention.

In another illustrative embodiment of the invention the yieldable attachment portion is provided by a ligament band. FIG. 5 shows an upper sole and lower sole held together by a ligament band 30. If viewed from the side this embodiment of a ligament band according to the invention extends from the toe portion of the upper sole to the heel portion of the lower sole.

Figure 6:
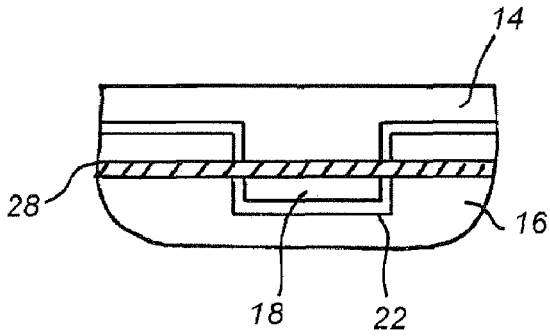
FIG. 6 is a rear cross sectional view of an upper and lower sole having a shear pin extending therethrough according to an illustrative embodiment of the invention.

FIG. 6 illustrates a front or rear cross sectional view of an upper sole 14 and lower sole 14 according to illustrative embodiments of the invention and showing a shear pin 28 extending therethrough. Although the longitudinal guiding portion is described hereinbefore generally with respect to a simple rail 18 and slot 22 configuration, persons having ordinary skill in the art should understand that a number of alternative configurations could be substituted therefore without departing from the spirit and scope of the present invention.

Figure 7:
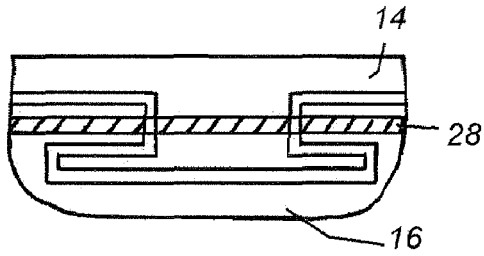
FIG. 7 is a rear cross sectional view of an upper and lower soles including an undercut portion in the longitudinal guiding element to prevent vertical separation therebetween according to an illustrative embodiment of the invention.

The longitudinal guiding portion allows translation of the lower sole relative to the upper sole in the longitudinal direction upon exertion of a predetermined critical shear force. The longitudinal guiding portion also prevents translation of the lower sole relative to the upper sole in the lateral direction. It is envisioned that alternative embodiments of the invention can include longitudinal guiding portions which include portions for preventing vertical translation of the lower sole relative to the upper sole. FIG. 7 shows a front or rear cross sectional view of an alternatively configured longitudinal guiding portion according to the present invention. In this embodiment, the slot in the lower sole includes an undercut. The rail extending from the upper sole includes a lateral extension that is captured by the undercut portion of the slot. This embodiment constrains relative sole translation in the lateral and vertical directions while allowing longitudinal translation. A shear pin 28 is shown to prevent longitudinal translation until the predetermined critical shear force is reached.

Figure 8:
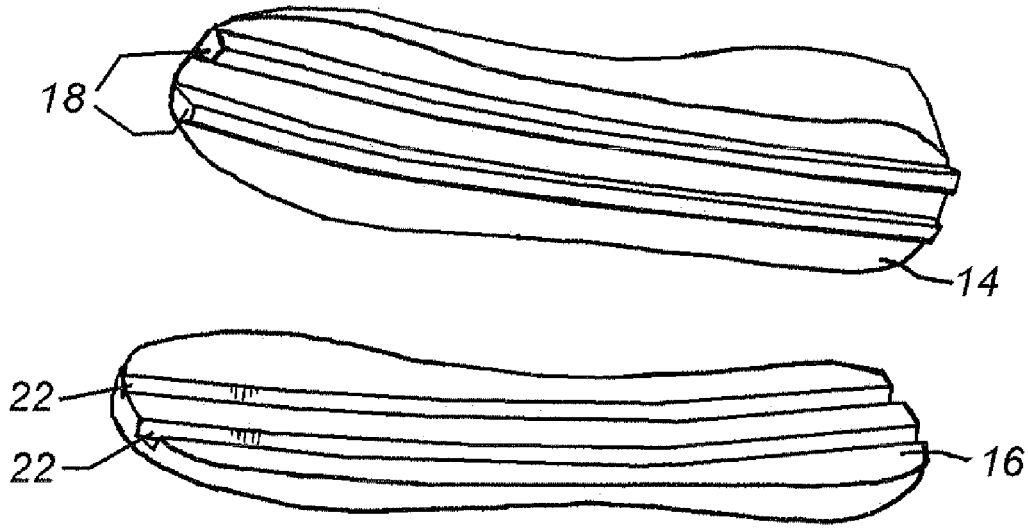
FIG. 8 is an exploded view of the upper and lower soles according to an illustrative embodiment of the invention including a plurality of rail and slot portions.
Figure 9:
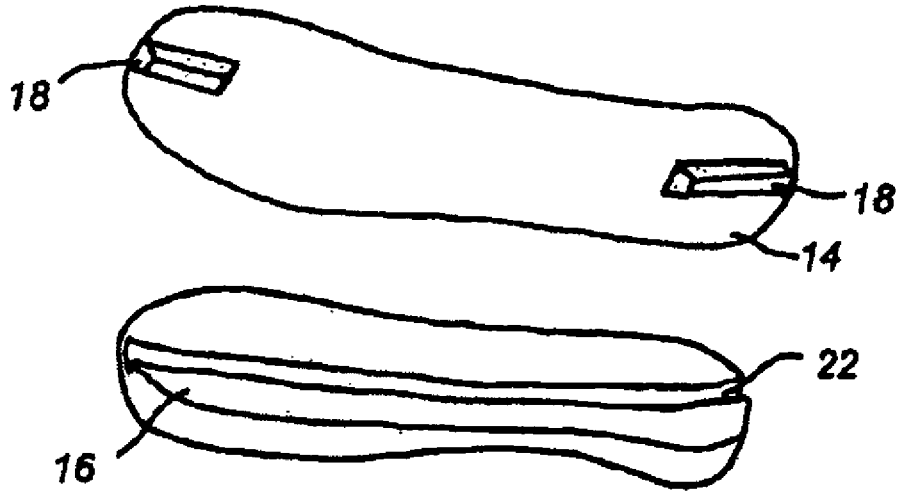
FIG. 9 is an exploded view of the upper and lower soles according to an illustrative embodiment of the invention including shortened rail segments.

Although the invention is described hereinbefore with respect to a single rail and slot to provide longitudinal guidance in relative translation between the upper sole 14 and lower sole 16, it is envisioned that many different longitudinal guiding structures can be employed within the spirit and scope of the present invention. For example, FIG. 8 illustrates an alternative embodiment of the present invention including a pair of longitudinal rails 18 in the upper sole 14 for engagement with a pair of longitudinal slots 22 in the lower sole 16. It is not necessary that the longitudinal rail(s) 18 and or slot(s) 22 extend along the entire length of the sole. Alternative embodiments are envisioned, for example, wherein only a few inches of longitudinal release are necessary to prevent injury to a user's ACL. Another embodiment of the invention is shown, for example, in FIG. 9 wherein the longitudinal rail includes discontinuous portions. Such alternative embodiments provide space in the slot for placement of energy absorbing components such as a ligament band or spring portion.

Figure 10:
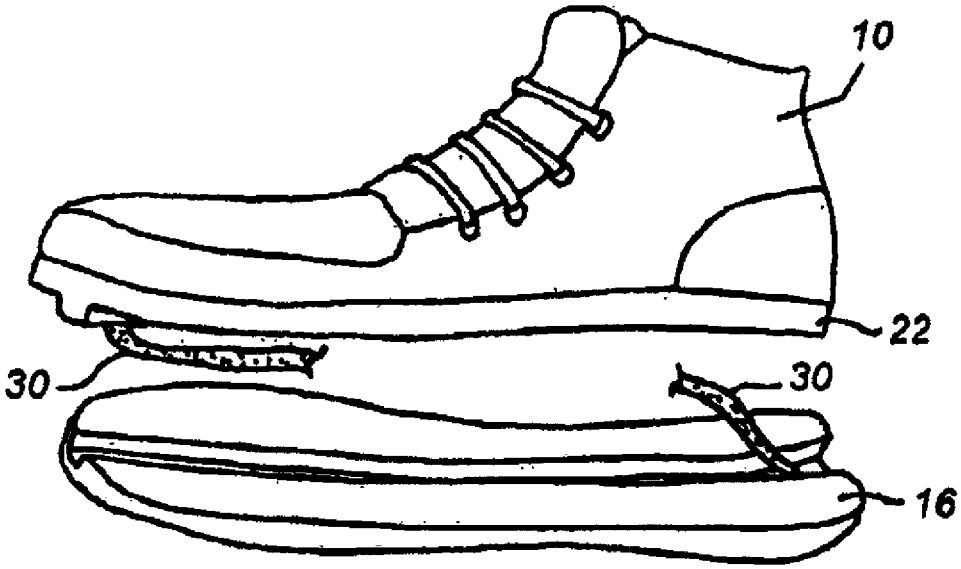
FIG. 10 is a exploded pictorial view of an athletic shoe according to an illustrative embodiment of the invention including a ligament band extending between the upper and lower soles.

FIG. 10 illustrates the shoe 10 according to an illustrative embodiment of the invention having a ligament band 30 connecting the toe end of the upper sole 14 to the heel end of the lower sole 16.

Figure 11:
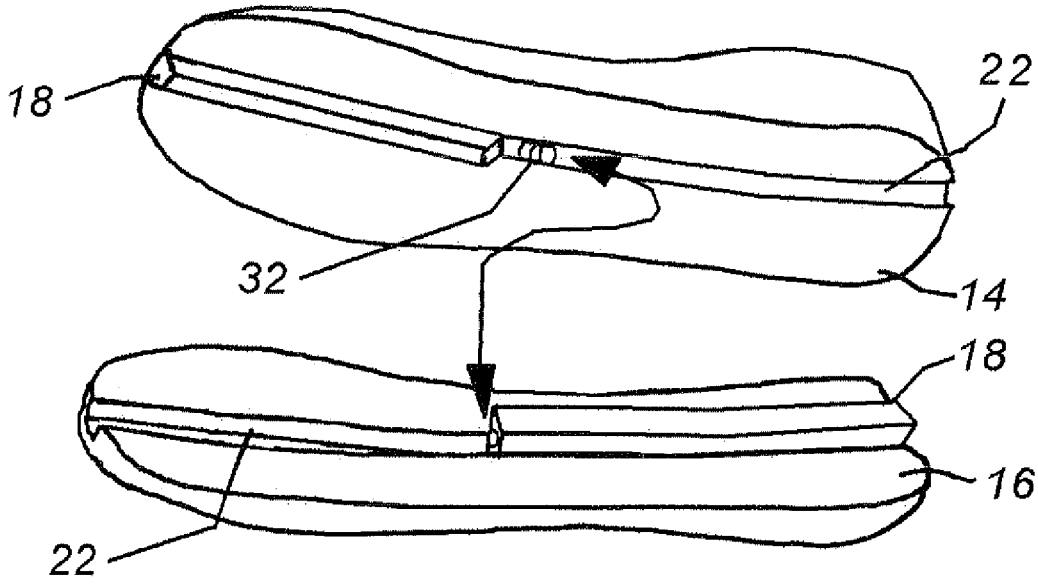
FIG. 11 is an exploded view of the upper and lower soles according to an illustrative embodiment of the invention including a spring element connected therebetween.

Another illustrative embodiment of the invention is shown in FIG. 11 wherein energy absorption is provided by a spring element 32 connected between the upper sole 14 and lower sole 16. This embodiment illustrates the use of a combined rail 18 and slot 22 in each of the upper sole 14 and lower sole 16 portions as longitudinal guiding portions. It envisioned that a spring element 32 can be chosen with an appropriate spring constant to allow longitudinal translation of the upper sole 14 relative to the lower sole 16 before sufficient tension is generated at the ACL to cause injury. Persons having ordinary skill in the art should appreciate that the weight of the user and type of activity in which the user is involved will be factors used to select a particular spring constant. This is true regardless of which type energy absorbing configuration is used, i.e. shear pin 28, ligament band 30, spring 32, spot welds 26 or releasable adhesive for example.

Figure 12:
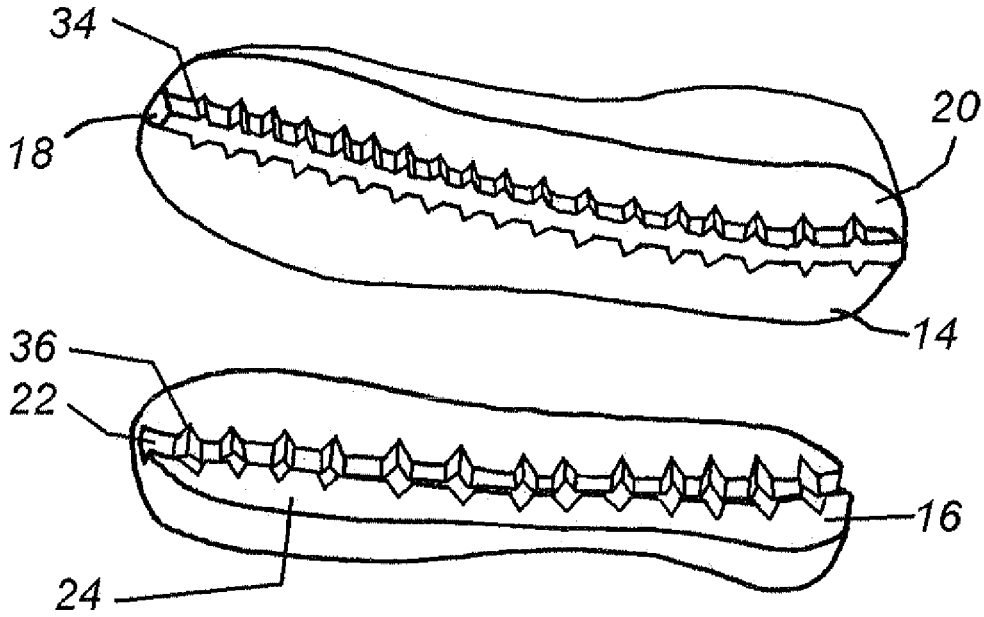
FIG. 12 is an exploded view of the upper and lower soles including controlled friction elements according to an illustrative embodiment of the invention.

In another embodiment of the present invention as illustrated in FIG. 12, calibrated friction elements are used to allow the upper sole 14 and lower sole 18 to release for translation in the longitudinal direction upon application of a predetermined longitudinal shear force applied therebetween. In the illustrative embodiment, the calibrate friction elements are a plurality of teeth 34 and grooves 36 formed in the upper rail 18 and/or slot 22 of the upper sole 14 and/or lower sole 16. Although the calibrated friction elements are shown on side surfaces of the rail 18 and/or slot 22, persons skilled in the art should appreciate that calibrated friction elements could also or alternatively be provided on the bottom surface of the rail 18 and/or top surface of the slot 22. Controlled friction elements could also be provided on the bottom surface 20 of the upper sole 14 or top 24 of the bottom sole 16. Although the controlled friction elements are illustrated as teeth 34 and grooves 36 in FIG. 12, it is envisioned that various other structures such as ribs, dimples, texture and the like could be substituted as controlled friction elements within the scope of the present invention.

Figure 13:
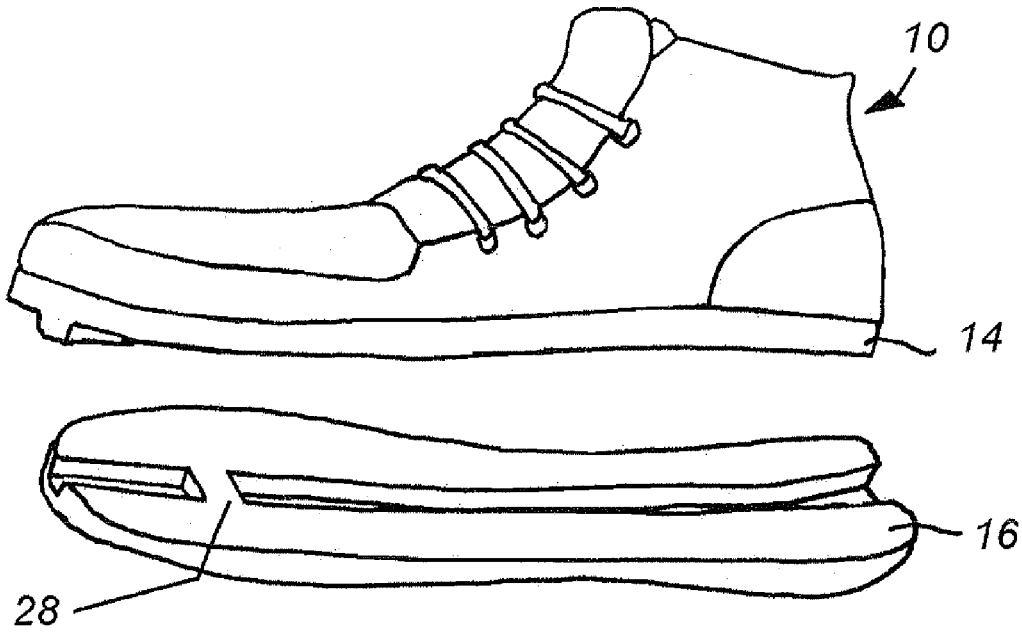
FIG. 13 is an exploded pictorial view of an athletic shoe having a shear pin integrally formed with a sole portion according to an illustrative embodiment of the invention.
Figure 14:
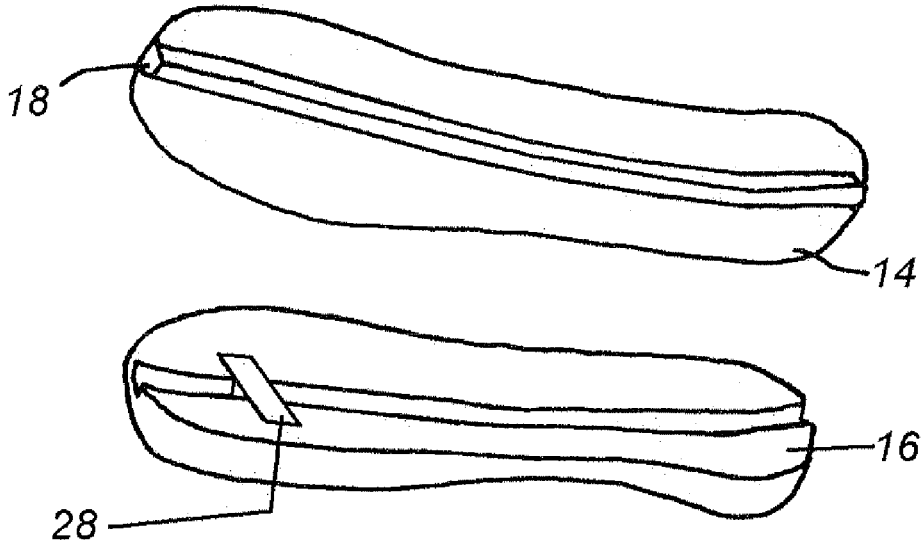
FIG. 14 is an exploded view of a top and bottom sole having a separately formed shear pin installed therein according to an illustrative embodiment of the invention.
Figure 15:
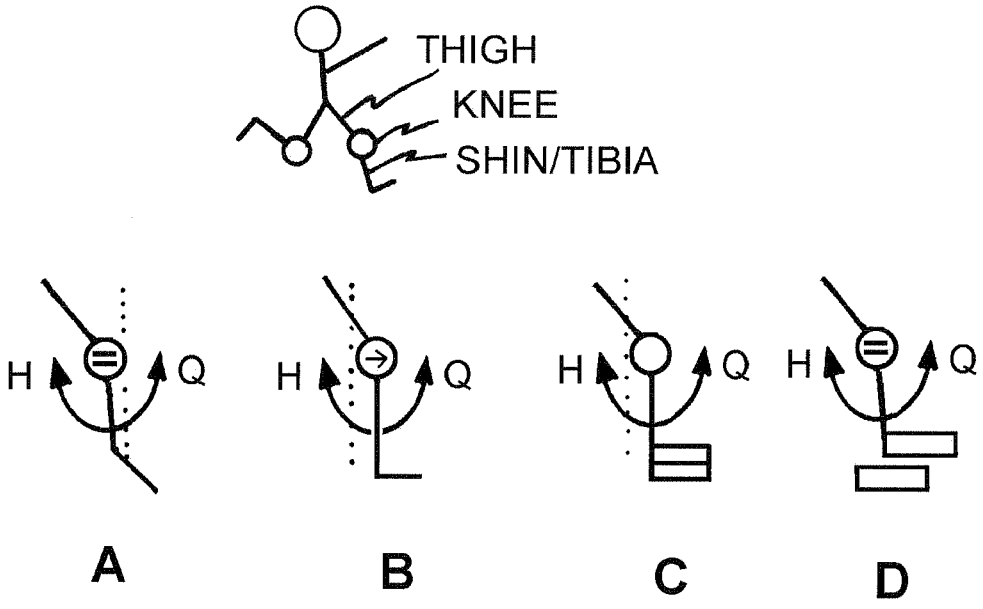
FIG. 15 A–D is a mechanical schematic diagram of the various forces acting on the ACL during use of the various embodiments of the invention.

Although certain embodiments of the present invention have been described hereinbefore to include shear pins 28, it should be appreciated by persons skilled in the art that the term shear pin does not necessarily include a separate component, but could be integrated within another component of the invention such as the upper sole 14 or lower sole 16, for example. An alternative embodiment of the invention is shown in FIG. 13 wherein a shear pin 28 is formed integrally with the upper and lower sole. FIG. 14 illustrates an alternative embodiment wherein a shear pin is separately formed. It is envisioned that separately formed shear pins 28 as shown in FIG. 14 for example would allow efficient manufacture of shoes having a plurality of release levels by selecting shear pins with appropriate yield levels.

Referring to FIGS. 15A, 15B, 15C and 15D, figurative (i.e. stick figure) and vectoral diagrams are shown illustrating a normal condition, an injured condition, a first sole element associated with a second sole element (i.e. new shoe sole design) and a first sole element disassociated with a second sole element (i.e. new shoe sole design). It should be noted that the variable "Q" in FIGS. 15A, 15B, 15C and 15D, represents force created by contraction of the quadriceps muscle, the variable "H" represents force created by contraction of the hamstring muscles and the dotted vertical line represents the center of gravity of the body.

FIG. 15A shows what happens when an athlete decelerates to stop, for example as when landing from a jump. The athlete land on his/her toes and the center of gravity of the body lies in front of the knee. The quadriceps and hamstrings contract in synchrony and the body comes to a rapid stop without any excessive force placed on the knee and ACL. This is represented by the "=" sign inside the knee. FIG. 15B shows what happens when the athlete suffers a non-contact ACL tear. In this case, the force diagram is different. The athlete typically lands on a flat foot and the center of gravity of the body now lies behind the axis of the knee. In an attempt to correct for this imbalance, the quadriceps contraction is much larger than usual. This leads to an imbalance between the pull of the quadriceps relative to that of the hamstrings. Since the foot is fixed to the floor, the net result is to pull the tibia forward (anterior) which places increase tension across the ACL. If this anterior force is large enough, then the ACL ruptures. This is represented by the "→" sign inside the knee.

FIG. 15C shows what happens when the athlete is wearing an injury preventing shoe sole and lands in the "at risk" position, as described above. The athlete is in imminent danger of rupturing their ACL. The proposed shoe sole alleviates this risk by providing a relief valve in the system. FIG. 15D shows the same scenario as described in FIG. 15B, except that in this example the athlete is wearing an injury preventing shoe sole. As can be seen, with the new sole in place the large, unbalanced quadriceps contraction causes the sole to slide apart and allows the leg to extend. The key to whether or not an ACL injury occurs is the foot. If the foot is fixed to the ground, then the force generated by the quadriceps works to pull the tibia forward. However, if the foot is allowed to move forward, then when the quadriceps contracts the leg simply extends and no increased force is translated to the ACL.

FIG. 16 provides a table summarizing characteristics of the athletic shoe sole as described above with respect to FIG. 15.

Figure 17:
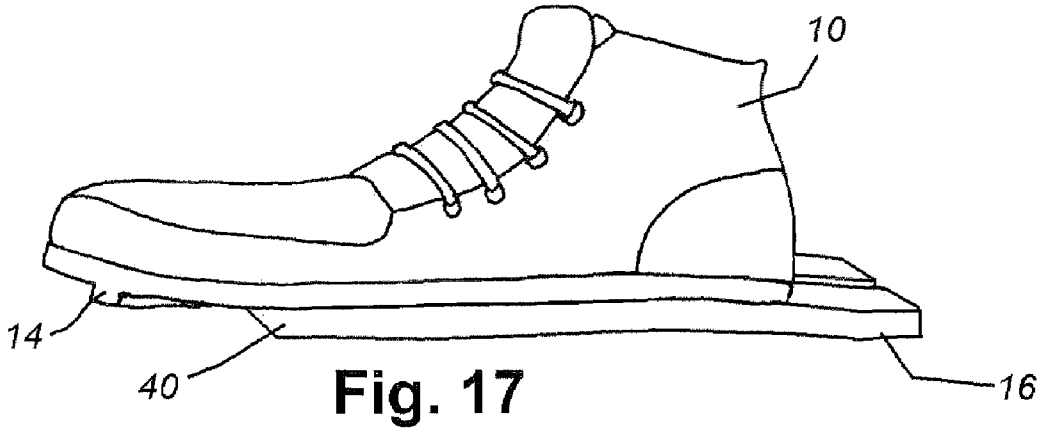
FIG. 17 is a pictorial view of an athletic shoe according to an illustrative embodiment of the invention after the upper and lower soles have been longitudinally translated relative to each other.

FIG. 17 illustrates how the two piece sole design will function when a user such as an athlete suddenly stops. If the force at the shoe-surface interface 40 approaches the force required to injure the user or the user's ACL, then the two pieces of the sole 14, 16 are designed to "fail". This allows the upper sole 14 and shoe 10 to become disassociated with the lower sole 16 and thus slide forward on the lower sole 16. The upper sole 14 slides past the lower sole 16 dissipating the force at the shoe-surface interface and preventing the tension across the ACL from rising to a level that could injury the ligament. Thus, the sole design provides a relief valve that prevents excess anterior shear in the knee.

It is envisioned that various embodiments of the present invention can be practiced wherein complete separation of the upper and lower sole results after sufficient guidance in the longitudinal direction by the longitudinal guiding features. Alternative embodiments of the invention are also envisioned wherein release is only temporary, such as wherein energy is absorbed by a spring component, and wherein the upper and lower sole return to their original orientation after the overstressing force is relaxed.

Although various embodiments of the invention are described herein with respect to horizontally oriented shear pins, persons having ordinary skill in the art should appreciate that vertically oriented shear pins could be substituted therefore without departing from the spirit and scope of the present invention. For example, it is envisioned that cleats could be threaded to a lower sole portion wherein one or more cleats could include a shear pin extending upward through the lower sole 16 and into the upper sole 14.

Although/the various embodiments of the invention are described herein as having upper and lower soles which extend along the entire length of a shoe, persons skilled in the art should appreciate that alternative embodiments of the invention could be practiced wherein the releasable upper and lower soles extend only along a portion of the length of a shoe. For example, it is envisioned that an athletic shoe according to the present invention could be constructed with a releasable heel portion or a releasable toe portion of a sole without departing from the spirit or scope of the present invention.

Although the various embodiments of the invention are described herein as having a longitudinal guiding element with a rectangular cross section including a rail on either the upper or lower sole and a receiving slot on the opposite sole, persons skilled in the art should appreciate that a number of different configurations of a longitudinal guiding element could be configured on the upper and lower soles within the scope of the present invention. For example, the matching geometry a rail and slot according to alternative embodiment of the invention can have an undercut cross section, a dovetail cross section, a keyhole shaped cross section and the like. Further, alternative embodiments of longitudinal guiding elements according to the present invention can include configurations that do not require a rail and slot configuration. For example, an alternative embodiment of a bottom sole could be configured with raised side edges oriented longitudinally. In this embodiment the top sole does not include a rail. Rather the side edges of the top sole are oriented longitudinally and are retained for longitudinal translation by the raised side edges of the bottom sole.

It is contemplated that various other additions and modifications can be made to a longitudinally releasable safety shoe without departing from the scope of the present invention. For example, it is envisioned that a removable safety element can be provided to prevent translation of the upper and lower sole before the user begins to engage in athletic activity. This would be useful for example to prevent the upper and lower soles from releasing while a user is walking down stairs, for example, to prevent a falling hazard. It is envisioned that users of certain embodiments of the invention could insert a removable safety rod having a high yield strength in place of a shear pin having a lower yield strength to prevent release before an athletic activity begins.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An athletic shoe comprising:

a body portion;

an upper sole element substantially permanently attached to said body portion; and a lower sole element releasably attached to said upper sole element such that lateral relative motion between said upper sole element and said lower sole element is prevented and longitudinal motion between said upper sole element and lower sole element is resisted up to a predetermined release force such that a predetermined release force in the longitudinal direction will cause the upper sole element to release from the lower sole element, and a force in the lateral direction will cause the upper sole element to release from the lower sole element, and a force in the lateral direction will not cause the upper sole element to release from the lower sole element, wherein said predetermined release force is designed to fail at a predetermined load or threshold force level to prevent knee injury to a wearer.

2. The athletic shoe according to claim 1 wherein the predetermined release force is selected to prevent injury to a user's knee.

3. The athletic shoe according to claim 1 wherein the predetermined release force is selected to be less than a force that is capable of generating a torn anterior cruciate ligament (ACL) when transmitted to a human knee.

4. The athletic shoe according to claim 1 wherein the predetermined release force results from wearing the athletic shoe during sports related activities.

5. The athletic shoe according to claim 1 wherein the predetermined release force results from a user's deceleration while a user is wearing the athletic shoe.

6. The athletic shoe according to claim 1 wherein the predetermined release force results from engagement of the lower sole element with a ground surface in response to a user's wearing the shoe.

7. An athletic shoe comprising:

a body portion;

an upper sole element substantially permanently attached to said body portion; and a lower sole element releasably attached to said upper sole element such that lateral relative motion between said upper sole element and said lower sole element is prevented and longitudinal motion between said upper sole element and lower sole element is resisted up to a predetermined release force such that a predetermined release force in the longitudinal direction will cause the upper sole element to release from the lower sole element, and a force in the lateral direction will not cause the upper sole element to release from the lower sole element wherein said predetermined release force is designed to fail at a predetermined load or threshold force level to prevent knee injury to a wearer.

8. An athletic shoe sole comprising:

an upper sole having a bottom surface including a first longitudinal guiding element;

a lower sole having a top surface including a second longitudinal guiding element;

said second longitudinal guiding element engaging said first longitudinal guiding element and constraining said upper sole to longitudinal motion relative to said lower sole upon exertion of a threshold longitudinal shear force therebetween a shear pin extending between said upper sole and said lower sole, wherein said shear pin is designed to fail at a predetermined load or threshold force level to release the lower sole from the upper sole to prevent knee injury to a wearer.

9. The athletic shoe sole according to claim 8 wherein said longitudinal guiding elements comprise a rail and slot.

10. The athletic shoe sole according to claim 8 wherein said breakaway portion comprises a controlled friction portion.

11. The athletic shoe sole according to claim 10 wherein said controlled friction portion comprises a plurality of teeth and grooves.

12. The athletic shoe sole according to claim 8 wherein said shear pin is formed integrally with said upper or lower sole portion.

13. The athletic shoe sole according to claim 8, wherein said breakaway portion comprises at least one spot weld.

14. The athletic shoe sole according to claim 8 wherein said breakaway portion comprises an adhesive layer.

15. The athletic shoe sole according to claim 8 comprising a ligament portion connected between said upper sole and said lower sole and preventing longitudinal translation between said upper sole and said lower sole unless a force exceeding a predetermined shear force is exerted therebetween.

16. The athletic shoe sole according to claim 15 wherein said ligament portion comprises an elastic band.

17. The athletic shoe sole according to claim 15 wherein said ligament portion comprises a spring.

18. The athletic shoe according to claim 8 further comprising cleats extending downward from said lower sole.

19. The athletic shoe according to claim 18 wherein at least one cleat includes a shear pin extending upward through said upper and lower sole elements.

20. The athletic shoe according to claim 8 further comprising means for preventing translation between said upper sole and said bottom sole.

21. The athletic shoe according to claim 8 wherein said shear pins are replaceable.

22. The athletic shoe sole according to claim 8 wherein the threshold longitudinal shear force is selected to prevent injury to a user's knee.

23. The athletic shoe sole according to claim 8 wherein the threshold longitudinal shear force is selected to be less than a force that is capable of generating a torn anterior cruciate ligament (ACL) when transmitted to a human knee.

24. The athletic shoe according to claim 8 wherein the threshold longitudinal shear force is selected to prevent injury to a user's knee.

25. The athletic shoe according to claim 8 wherein the threshold longitudinal shear force is selected to be less than a force that is capable of generating a torn anterior cruciate ligament (ACL) when transmitted to a human knee.

* * * * *